US007123867B2

(12) United States Patent
Schultheis et al.

(10) Patent No.: US 7,123,867 B2
(45) Date of Patent: Oct. 17, 2006

(54) ELECTROPHOTOGRAPHIC PRINTING DEVICE

(75) Inventors: Bernd Schultheis, Schwabenheim (DE); Birgit Lattermann, Ried-Stadt (DE); Dieter Jung, Daaden (DE)

(73) Assignee: Schott AG, Mainz (DE)

( * ) Notice: Subject to any disclaimer, the term of this patent is extended or adjusted under 35 U.S.C. 154(b) by 0 days.

(21) Appl. No.: 10/362,548

(22) PCT Filed: Oct. 6, 2001

(86) PCT No.: PCT/EP01/11540

§ 371 (c)(1),
(2), (4) Date: Jun. 24, 2003

(87) PCT Pub. No.: WO02/35294

PCT Pub. Date: May 2, 2002

(65) Prior Publication Data

US 2004/0028430 A1 Feb. 12, 2004

(30) Foreign Application Priority Data

Oct. 20, 2000 (DE) ..... 100 52 370

(51) Int. Cl.
*G03G 15/16* (2006.01)

(52) U.S. Cl. ..... 399/297; 399/310

(58) Field of Classification Search ..... 399/297, 399/308, 310, 311, 312
See application file for complete search history.

(56) References Cited

U.S. PATENT DOCUMENTS 4,674,860 A * 6/1987 Tokunaga et al.
5,539,501 A * 7/1996 Yu et al.
6,487,386 B1 * 11/2002 Zimmer et al. ..... 399/297

FOREIGN PATENT DOCUMENTS

DE 198 49 500 5/2000
JP 58172667 A * 10/1983

* cited by examiner

*Primary Examiner*—David M. Gray
*Assistant Examiner*—Ryan Gleitz
(74) *Attorney, Agent, or Firm*—Pauley Peterson & Erickson

(57) ABSTRACT

An electrophotographic printing device with a developer unit and a photoconductor. The photoconductor is either directly connected to a substrate to be printed in the region of a transfer zone, or is connected by an intermediate circuit of one or several transfer media. At least one charger is provided for the substrate and the substrate may be transported through the transfer zone by a transport device. According to this invention, an effective transfer of toner to the substrate surface can be achieved with such an arrangement, even with a poor electrically-conducting and thick-walled, sheet-like substrate, whereby a charger is arranged as the primary charger in the transport direction and a secondary charger is arranged in the region after the transfer zone and both primary and secondary chargers affect the surface of the substrate to be printed.

26 Claims, 1 Drawing Sheet

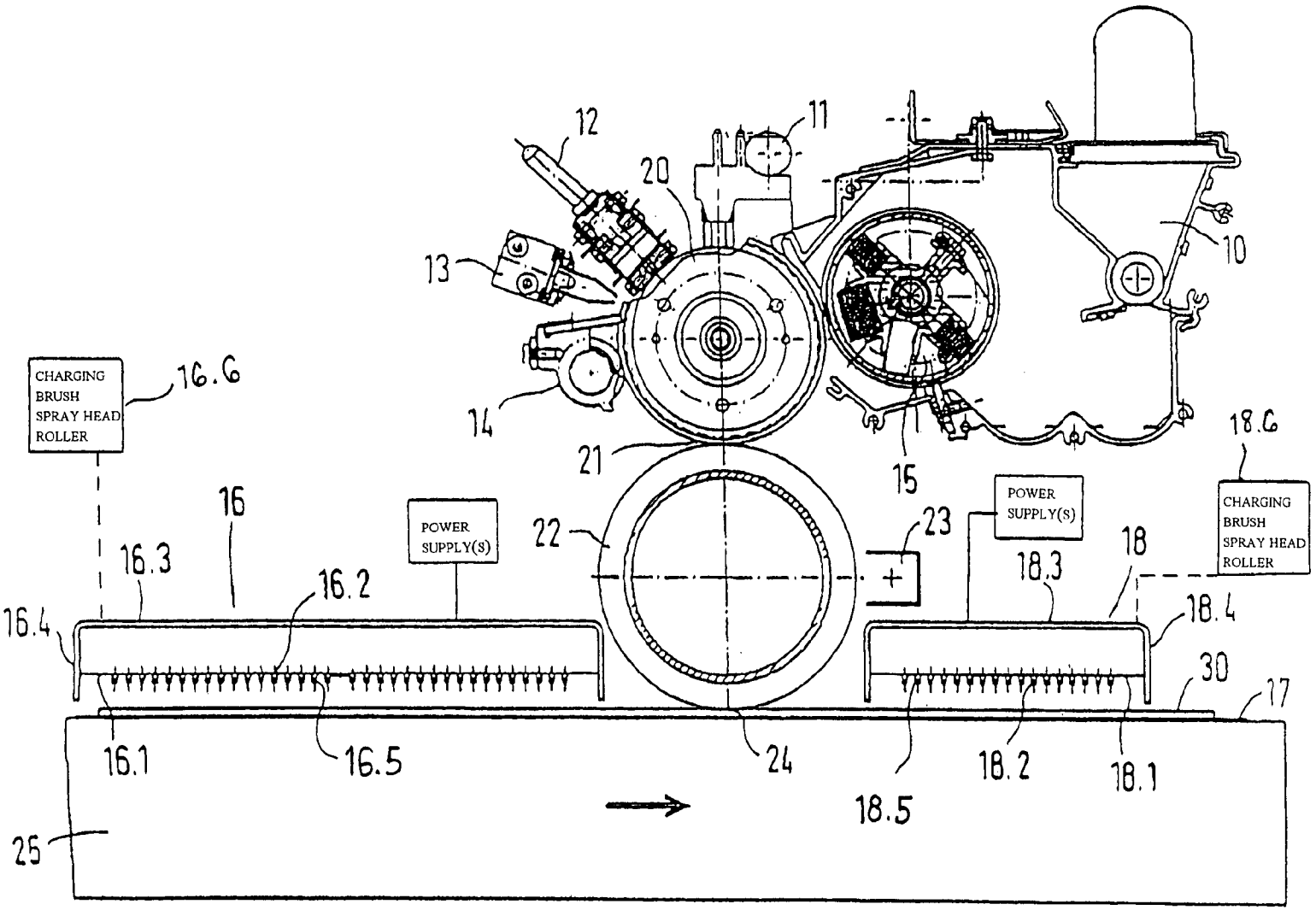
CHARGING
BRUSH
SPRAY HEAD
ROLLER
POWER
SUPPLY(S)
POWER
SUPPLY(S)
CHARGING
BRUSH
SPRAY HEAD
ROLLER
10
11
12
13
14
15
16
16.1
16.2
16.3
16.4
16.5
16.6
17
18
18.1
18.2
18.3
18.4
18.5
18.6
20
21
22
23
24
25
30

ELECTROPHOTOGRAPHIC PRINTING DEVICE

BACKGROUND OF THE INVENTION

1. Field of the Invention

This invention relates to an electrophotographic printing device, having a developer unit and a photoconductor, wherein the photoconductor is connected directly or with the interposition of one or several transfer media with a substrate to be imprinted, located in a transfer zone, wherein at least one charger is assigned to the substrate, and wherein the substrate can be conveyed through the transfer zone by a conveying device.

2. Discussion of Related Art

A printing device is known from German Patent Reference DE 198 49 500 A1. There, a developer unit is used, in which a toner is stored. A photoconductor drum is assigned to the developer unit. The photoconductor drum can be activated on its surface by an exposure device, so that a toner application becomes possible. The photoconductor drum is in contact with a transfer roller via a contact line. The toner is transferred from the photoconductor drum to the transfer roller using coronas. The transfer roller rolls off on the surface of a substrate which is to be imprinted. In the process the toner is transferred to the substrate surface using a corona arranged on the underside of the substrate. Two transfer processes of the toner image take place with this arrangement. The first transfer process occurs during the transfer from the photoconductor drum to the transfer roller, the second transfer process occurs during the transfer of the toner to the substrate. No complete transfer of the toner takes place during each of the transfer processes. However, the greatest possible transfer of the toner should be attempted, so that clear print images with sharp contours can be generated. In this connection the design and arrangement of the corona in the area of the second transfer process is of importance. It is necessary to assure that the surface of the substrate to be imprinted is sufficiently electrostatically charged. With flat substrates of greater wall thickness in particular, insufficient charging occurs when the substrate is of a material which does not conduct electricity well.

SUMMARY OF THE INVENTION

It is one object of this invention to provide an electrophotographic printing device of the type mentioned above but which has an effective transfer of the toner to the substrate, regardless of the thickness of the material of the substrate and its chemical properties.

This object is achieved with a charger arranged on the side facing the surface of the substrate to be imprinted and directly acts on this surface to be imprinted.

A dependable charge is achieved because, in a reversal of the prior art, the charger no longer act on the underside of the substrate, but directly on its surface to be coated. The charge can then be applied regardless of the consistency of the substrate.

In accordance with one embodiment of this invention, one charger, as the primary charger, is arranged upstream of the transfer zone in the conveying direction, and a secondary charger downstream of the transfer zone, and that the primary and secondary chargers act on the surface of the substrate to be imprinted.

With this arrangement, the substrate is first conducted to the primary charger. Its surface to be imprinted can then be charged. Thereafter the substrate is conducted through the transfer zone. During this, toner is applied to the surface to be imprinted. During continued conveyance the substrate leaves the primary charger. Depending on the size of the substrate and of the print image, during this the toner transfer to the substrate is not yet finished. In this case the secondary charger prevents a drop in the charge by recharging the substrate. It is thus possible to assure an even and effective transfer of the toner material throughout the entire coating process.

It is possible for the effects of the primary and/or secondary charger to take place with or without contact. For example, a charging brush can glide over the surface to be imprinted, or a charging roller can roll off on it. Particularly good charging results can be achieved in the course of the contactless charge method when using a primary, or a secondary charging corona. Charging spray heads with piezo-effect charging generators can also be employed as contactless chargers. In accordance with a preferred embodiment variation of this invention, the primary and/or secondary coronas are designed as flat coronas, which cover the entire width extending transversely with respect to the conveying direction of the surface of the substrate to be imprinted, and at least also partially over the surface in the conveying direction.

With this arrangement it is possible to charge large surfaces of the substrate, which makes a rapid charge application possible. In this way it is also possible to apply high substrate feeding speeds.

In one embodiment of this invention, the primary charging corona and/or the secondary charging corona have a corona wire holder in which several corona wires, which are arranged next to each other, are held under tension, and the corona wires are connected to a uniform electrical potential. Because all corona wires have a uniform electrical potential, it is possible to generate an even voltage image. Thus the corona wire holders are installed in a housing and are electrically insulated against it, the housing is connected with an electrical counter-potential, and the housing shields the photoconductor and/or the transfer medium against the corona wires. The housing prevents the corona wires from affecting the charge image on the image drum, or on the transfer roller.

In accordance with another embodiment of this invention, the corona wires are designed as individual wires, which have a spring element on one of their ends, by which the corona wire is suspended from a first corona wire holder, and the other end of the corona wire is fastened on an oppositely located corona wire holder. With this it is possible to assure that all corona wires are uniformly suspended. Thus their sagging does not extend in different lengths, which would generate a non-uniform charge image on the substrate surface.

However, at least two of the corona wires which are arranged next to each other are also formed by a continuous piece of wire, which is respectively reversed at the corona wire holders, and the corona wires are uniformly prestressed.

For assuring a continuously uniform toner transfer, the primary and the secondary charging coronas charge the substrate with a potential of the same sign, wherein the size of the potential on the surface of the substrate does not differ by more than 50% from the larger potential value.

A rapid surface charge can be achieved if the primary, as well as the secondary corona, are each assigned their own power supply unit. This can be further improved if several power supply units, each of which supplies a group of corona wires with a voltage, are assigned to each of the primary and/or secondary coronas.

Typically the voltage potential lies between 1 and 10 kV. In this case it is particularly advantageous if the voltage of the primary and the secondary coronas can be adjusted separately from each other.

To assure that while passing through the transfer zone the substrate is always charged by at least one charging corona, the distance of the primary charging corona from the secondary charging corona is less in the conveying direction than the extension in this direction of the surface of the substrate to be imprinted.

To prevent the substrate from being discharged via the conveying device the substrate is placed on the conveying device with the interposition of an insulator. The interposed layer has an insulated plastic material, which is highly resistant to disruptive discharge (for example polyimide, polyamide, epoxy resin, laminated paper, bakelite). Layers of a ceramic material (for example $Al_2O_3$) or thin glass are also conceivable.

BRIEF DESCRIPTION OF THE DRAWING

This invention is explained in greater detail in view of an exemplary embodiment represented in the drawing which shows a lateral sectional view a device for the electrostatic imprinting of substrates, in particular plate-shaped ones.

DESCRIPTION OF PREFERRED EMBODIMENTS

The substrate 30 is placed on a conveying device 25 with an insulator 17 interposed. For example, the conveying device 25 can be a linearly displaceable table or a conveyor belt. A primary charging corona 16 and a secondary charging corona 18 are assigned as chargers or charging means to the substrate 30 and provide the surface of the substrate 30 with a charge.

The primary and secondary charging coronas 16 and 18 are substantially similarly constructed, wherein the primary charging corona is of a larger size. The primary and secondary charging coronas 16 and 18 are designed as flat coronas, but it will be understood that the coronas could be in the form of a charging brush, charging spray head, or charging roller, as indicated in the alternative by dashed lines to each of boxes 16.6 and 18.6. Each one has a corona wire holder 16.1, 18.1. The corona wire holder essentially has two combs, which extend parallel in respect to each other and between which the corona wires 16.2, 18.2 are suspended. In this case the ends of the corona wires 16.2, 18.2 are suspended on the teeth of the corona wire holders 16.1, 18.1. Each corona wire 16.2, 18.2 has a spring element 16.5, 18.5 at one of its ends. A loop is provided at the other end. The corona wires 16.2, 18.2 can be suspended by means of the loop from a comb of the corona wire holders 16.1, 18.1. The end of the corona wires 16.2, 18.2 having a spring element 16.5, 18.5 can be suspended from the oppositely located comb. In the process a tension of the corona wires 16.2, 18.2 in the corona wire holders 16.1, 18.1 is achieved by means of the spring element. Since an identical spring element is assigned to each corona wire 16.2, 18.2, the tensile stress in each one of the individual corona wires 16.2, 18.2 is identical. It is achieved by means of this that the corona wires 16.2, 18.2 are uniformly tightly stretched. As can be seen in the drawings, the primary charging corona 16 is divided at the center of the corona wire holders 16.1, 18.1. An insulation is provided here. In this way two sections of corona wires 16.2, 18.2 are formed. At least one power supply unit is indicated as assigned to each one of these sections, which supplies the corona wires 16.2, 18.2 with electrical current. A power supply unit is also assigned to the secondary charging corona 18. The corona wire holder 16.1, 8.1 has been placed into a housing 16.3, 18.3. The housing 16.3, 18.3 has a cover section, around which a lateral wall 16.4 is placed, which protrudes in the direction toward the substrate 30.

The primary and the secondary charging coronas 16 and 18 are arranged opposite the substrate surface 30 to be imprinted. Thus they can act directly on the surface of the substrate 30. A transfer medium 22 of an electrophotographic unit is arranged in the area between the primary and the secondary charging coronas 16 and 18. In the present embodiment, the transfer medium 22 is embodied as a cylinder body. However, it can also be designed as an endlessly rotating belt. The transfer medium 22 is in contact with the substrate 30 in the area of a contact zone 24. A charging corona 23 is arranged in the transfer medium 22. The charging corona 23 charges the surface of the transfer medium 22, wherein the charge has a polarity opposite to the charge of the substrate.

However, with an appropriate design of the photoconductor 20, the transfer medium 22 can be omitted.

The electrophotographic unit also has a developer unit 10, which is constructed in a known manner. A toner, for example a ceramic toner or a thermoplastic or duromeric plastic toner, is stored in the developer unit 10. The developer unit 10 has a developer drum 15, by which the toner is conducted to a photoconductor 20. The photoconductor 20 is embodied to be cylinder-shaped and is in a linear engagement with the transfer medium 22 in a contact zone 21.

An exposure device 11 is provided above the photoconductor 20, which exposes a photosensitive layer of the photoconductor in a known manner. A latent electrostatic charge image is created by this. Because of this charge image it is possible to apply toner particles from the developer drum 15 to the outer conductor layer of the photoconductor 20 by means of electrostatic actions. The toner particles are transferred to the transfer medium 22 in the area of the contact zone 21. Toner remnants, which possibly still adhere to the photoconductor 20, are removed by a cleaning unit 14, which follows the contact zone 21. A discharge light 13 following the cleaning unit 14 discharges the photosensitive coating of the photoconductor. Then this photosensitive layer is returned to a uniform charge structure by means of a charging corona 12, so that it can again be provided with an electrostatic charge image by the exposure device 11. In the course of the printing operation the substrate 30 is evenly linearly displaced by means of the conveying device 25. In the process, the transfer medium 22 rolls off either passively or in a driven manner on the surface of the substrate 30 to be imprinted. In the course of this the toner on the transfer medium 22 is transferred to the substrate 30 in the transfer zone 24. This transfer takes place in particular because the primary and the secondary charging coronas cause the charging of the entire surface of the substrate surface. As already mentioned above, this charge is polarized opposite to the charge on the transfer medium 22, so that a dependable toner transfer of high effectiveness can take place.

As shown in the drawing, the distance in the conveying direction between the primary and the secondary charging coronas 16 and 18 is selected to be less than the extent of the substrate in this direction. Thus the substrate 30 is continuously charged during its entire passage through the transfer zone 24. When the substrate 30 leaves the charging area of the primary corona 16, it is in contact with the charging area of the secondary charging corona 18.

Some examples are shown in what follows, which describe the preferred applications of the above described device in greater detail:

1. Imprinting of plate-shaped glass, glass-ceramic or ceramic materials with ceramic toners for decorating purposes. Following imprinting, as a rule the toner is pre-fixed and is subsequently fired at temperatures between 500 and 1000° Celsius. Examples of use are: decorated glass-ceramic cooktops, decorated glass-ceramic layered stove tiles, decorated glass products, such as stove front plates, control panels, glass for shower enclosures, signs made of glass, glass doors, glass tiles, glass in furniture, decorated ceramic articles, such as tiles, etc.

2. Imprinting of plate-shaped plastic materials, or glass or glass-ceramic materials with thermoplastic and/or thermoset plastic toners for decorative purposes. Following imprinting, as a rule the toner is pre-fixed and is subsequently fired at temperatures between 120 and 200° Celsius, preferably 150 to 180° Celsius. Examples of use are: decorated plastic surfaces made of thermoplastic or thermoset plastic materials such as, for example, plastic surfaces in the field of furniture or small household devices, tabletops, front panels, or glass materials such as, for example, signs.

3. Imprinting of glass, glass-ceramic or plastic surfaces for a specific modification of the surface properties, for example for imprinting electrically conductive surfaces, for surface hardening, or the like. As a rule this is also followed by heating processes for firing, tempering, or the like.

It is thus possible to effectively imprint plate-shaped materials in particular. Slight unevenesses of the substrate surface as a result of processing are compensated by the arrangement in accordance with this invention. For compensating surface uneveness it is also possible to provide the transfer medium with a flexible coating placed on the surface of the substrate. The surface of the photoconductor 20 can have a flexible coating, in the same way. In that case the photoconductor 20 can be placed directly on the surface of the substrate 23 without using a transfer medium 22.

With charging from the side to be imprinted, a toner transfer takes place independently to a large extent of the substrate material and of the substrate thickness. It is then possible, if desired, to provide an individual adaptation to the substrate material and to the material thickness by adapting the corona voltage.

What is claimed is:

1. In an electrophotographic printing device, having a developer unit and a photoconductor, wherein the photoconductor is connected directly or with interposition of at least one transfer medium with a substrate to be imprinted, located in a transfer zone, wherein a charger is assigned to the substrate, and wherein the substrate can be conveyed through the transfer zone by a conveying device, the improvement comprising:

the charger arranged on a side facing a surface of the substrate (30) to be imprinted and directly acting on the surface to be imprinted and wherein the charger is a primary charger arranged upstream of the transfer zone in a conveying direction and a secondary charger downstream of the transfer zone, and the primary charger and the secondary charger act on the surface of the substrate (30) to be imprinted and wherein the primary charger and the secondary charger are of the same polarity, and wherein a distance of the primary charger (16) from the secondary charger (18) is less in the conveying direction than the extension in the conveying direction of the surface of the substrate (30) to be imprinted, and the substrate is one of glass, plastic, ceramic, or ceramic-glass.

2. In the electrophotographic printing device in accordance with claim 1, wherein at least one of the primary charger and the secondary charger are formed by at least one of a primary charging corona, a secondary charging corona (16, 18), a primary charging brush, a secondary charging brush, a primary charging spray head, a secondary charging spray head, a primary charging roller, and a secondary charging roller.

3. In the electrophotographic printing device in accordance with claim 2, wherein the primary charging corona and secondary charging corona (16 and 18) are designed as flat coronas which cover an entire width extending transversely with respect to the conveying direction of the surface of the substrate (30) to be imprinted, and at least partially over the surface in the conveying direction.

4. In the electrophotographic printing device in accordance with claim 3, wherein at least one of the primary charging corona (16) and the secondary charging corona (18) have a corona wire holder (16.1, 18.1) in which several corona wires (16.2, 18.2) are arranged next to each other and are held under tension, and the corona wires (16.2, 18.2) are connected with a uniform electrical potential.

5. In the electrophotographic printing device in accordance with claim 2, wherein the corona wire holders are installed in a housing (16.3, 18.3) and are electrically insulated against the housing (16.3, 18.3), the housing (16.3, 18.3) is connected with an electrical counter-potential, and the housing (15.3, 18.3) shields at least one of the photoconductor (20) and the transfer medium against the corona wires (16.2, 18.2).

6. In the electrophotographic printing device in accordance with claim 5, wherein at least two of the corona wires (16.2, 18.2) which are arranged next to each other are formed by a continuous piece of wire which is respectively reversed at the corona wire holders (16.1, 18.2), and the corona wires (16.2, 18.2) are uniformly prestressed.

7. In the electrophotographic printing device in accordance with claim 6, wherein the primary and the secondary charging coronas (16 and 18) charge the substrate (30) with a potential of a same sign, and a size of the potential on the surface of the substrate (30) differs by not more than 50% from a larger potential value.

8. In the electrophotographic printing device in accordance with claim 7, wherein for current supply, the primary and the secondary coronas (16 and 18) each is assigned a power supply unit.

9. In the electrophotographic printing device in accordance with claim 8, wherein the primary and the secondary coronas (16, 18) each is assigned several power supply units, each of which supplies a group of the corona wires with a voltage.

10. In the electrophotographic printing device in accordance with claim 9, wherein the voltage of the primary and the secondary coronas are adjusted separately from each other.

11. In the electrophotographic printing device in accordance with claim 10, wherein the substrate (30) is placed on the conveying device (25) with an interposition of an insulator (17).

12. In the electrophotographic printing device in accordance with claim 11, wherein the insulator (17) is made of an insulating plastic material which is resistant to disruptive discharge.

13. In the electrophotographic printing device in accordance with claim 1, wherein a primary charging corona and a secondary charging corona (16 and 18) are designed as flat coronas which cover an entire width extending transversely with respect to a conveying direction of the surface of the substrate (30) to be imprinted, and at least partially over the surface in the conveying direction.

14. In the electrophotographic printing device in accordance with claim 2, wherein at least one of the primary charging corona (16) and the secondary charging corona (18) has a corona wire holder (16.1, 18.1) in which several corona wires (16.2, 18.2) are arranged next to each other and are held under tension, and the corona wires (16.2, 18.2) are connected with a uniform electrical potential.

15. In the electrophotographic printing device in accordance with claim 4, wherein at least two of the corona wires (16.2, 18.2) which are arranged next to each other are formed by a continuous piece of wire which is respectively reversed at the corona wire holders (16.1, 18.2), and the corona wires (16.2, 18.2) are uniformly prestressed.

16. In the electrophotographic printing device in accordance with claim 1, wherein primary and secondary charging coronas (16 and 18) charge the substrate (30) with a potential of a same sign, and a size of the potential on the surface of the substrate (30) differs by not more than 50% from a larger potential value.

17. In the electrophotographic printing device in accordance with claim 1, wherein for current supply, primary and secondary charging coronas (16 and 18), each is assigned a power supply unit.

18. In the electrophotographic printing device in accordance with claim 1, further comprising primary and secondary charging coronas (16, 18) in which each is assigned several power supply units, each of which supplies a group of corona wires with a voltage.

19. In the electrophotographic printing device in accordance with claim 1, wherein voltages of the primary and the secondary chargers are adjusted separately from each other.

20. In the electrophotographic printing device in accordance with claim 1, further including a primary charging corona and a secondary charging corona, and wherein a distance of the primary charging corona (16) from the secondary charging corona (18) is less in a conveying direction than an extension in the conveying direction of the surface of the substrate (30) to be imprinted.

21. In the electrophotographic printing device in accordance with claim 1, wherein the substrate (30) is placed on the conveying device (25) with an interposition of an insulator (17).

22. In the electrophotographic printing device in accordance with claim 21, wherein the insulator (17) is made of an abrasion-resistant and mechanically stressable ceramic or silicate material.

23. In the electrophotographic printing device in accordance with claim 1, wherein the substrate is charged in succession by the primary charger, both the primary charger and the secondary charger, and the secondary charger.

24. In an electrophotographic printing device, having a developer unit and a photoconductor, wherein the photoconductor is connected directly or with interposition of at least one transfer medium with a substrate to be imprinted, located in a transfer zone, wherein a charger is assigned to the substrate, and wherein the substrate can be conveyed through the transfer zone by a conveying device, the improvement comprising:

the charger arranged on a side facing a surface of the substrate (30) to be imprinted and directly acting on the surface to be imprinted and wherein the charger is a primary charger arranged upstream of the transfer zone in a conveying direction and a secondary charger downstream of the transfer zone, and the primary charger and the secondary charger act on the surface of the substrate (30) to be imprinted and wherein the primary charger and the secondary charger are of the same polarity, and wherein a distance of the primary charger (16) from the secondary charger (18) is less in the conveying direction than the extension in the conveying direction of the surface of the substrate (30) to be imprinted, at least one of the primary charger and the secondary charger formed by at least one of a primary charging corona, a secondary charging corona (16, 18), a primary charging brush, a secondary charging brush, a primary charging spray head, a secondary charging spray head, a primary charging roller, and a secondary charging roller, the corona wire holders installed in a housing (16.3, 18.3) and electrically insulated against the housing (16.3, 18.3), the housing (16.3, 18.3) connected with an electrical counter-potential, the housing (15.3, 18.3) shields at least one of the photoconductor (20) and the transfer medium against the corona wires (16.2, 18.2), and the corona wires (16.2, 18.2) designed as individual wires which have a spring element on one end by which each of the corona wires (16.2, 18.2) is suspended from a first corona wire holder (16.1, 18.1), and an other end of the corona wires (16.2, 18.2) is fastened on an oppositely located corona wire holder (16.1, 18.1).

25. In an electrophotographic printing device, having a developer unit and a photoconductor, wherein the photoconductor is connected directly or with interposition of at least one transfer medium with a substrate to be imprinted, located in a transfer zone, wherein a charger is assigned to the substrate, and wherein the substrate can be conveyed through the transfer zone by a conveying device, the improvement comprising:

the charger arranged on a side facing a surface of the substrate (30) to be imprinted and directly acting on the surface to be imprinted and wherein the charger is a primary charger arranged upstream of the transfer zone in a conveying direction and a secondary charger downstream of the transfer zone, and the primary charger and the secondary charger act on the surface of the substrate (30) to be imprinted and wherein the primary charger and the secondary charger are of the same polarity, and wherein a distance of the primary charger (16) from the secondary charger (18) is less in the conveying direction than the extension in the conveying direction of the surface of the substrate (30) to be imprinted, at least one of the primary charger and the secondary charger formed by at least one of a primary charging corona, a secondary charging corona (16, 18), a primary charging brush, a secondary charging brush, a primary charging spray head, a secondary charging spray head, a primary charging roller, and a secondary charging roller, the corona wire holders installed in a housing (16.3, 18.3) and electrically insulated against the housing (16.3, 18.3), the housing (16.3, 18.3) connected with an electrical counter-potential, the housing (15.3, 18.3) shields at least one of the photoconductor (20) and the transfer medium against the corona wires (16.2, 18.2), at least two of the corona wires (16.2, 18.2) which are arranged next to each other formed by a continuous piece of wire which is respectively reversed at the corona wire holders (16.1, 18.2), the corona wires (16.2, 18.2) uniformly prestressed, the primary and the secondary charging coronas (16 and 18) charging the substrate (30) with a potential of a same sign, a size of the potential on the surface of the substrate (30) differing by not more than 50% from a larger potential value, for current supply the primary and the secondary coronas (16 and 18) each assigned a power supply unit, the primary and the secondary coronas (16, 18) each assigned several power supply units, each of which supplies a group of the corona wires with a voltage, the voltage of the primary and the secondary coronas adjusted separately from each other, the substrate (30) placed on the conveying device (25) with an interposition of an insulator (17), and the insulator (17) made of an abrasion-resistant and mechanically stressable ceramic or silicate material.

26. In an electrophotographic printing device, having a developer unit and a photoconductor, wherein the photoconductor is connected directly or with interposition of at least one transfer medium with a substrate to be imprinted, located in a transfer zone, wherein a charger is assigned to the substrate, and wherein the substrate can be conveyed through the transfer zone by a conveying device, the improvement comprising:

the charger arranged on a side facing a surface of the substrate (30) to be imprinted and directly acting on the surface to be imprinted and wherein the charger is a primary charger arranged upstream of the transfer zone in a conveying direction and a secondary charger downstream of the transfer zone, and the primary charger and the secondary charger act on the surface of the substrate (30) to be imprinted and wherein the primary charger and the secondary charger are of the same polarity, and wherein a distance of the primary charger (16) from the secondary charger (18) is less in the conveying direction than the extension in the conveying direction of the surface of the substrate (30) to be imprinted, at least one of the primary charger and the secondary charger formed by at least one of a primary charging corona, a secondary charging corona (16, 18), a primary charging brush, a secondary charging brush, a primary charging spray head, a secondary charging spray head, a primary charging roller, and a secondary charging roller, the primary charging corona and secondary charging corona (16 and 18) are designed as flat coronas which cover an entire width extending transversely with respect to the conveying direction of the surface of the substrate (30) to be imprinted, and at least partially over the surface in the conveying direction, at least one of the primary charging corona (16) and the secondary charging corona (18) have a corona wire holder (16.1, 18.1) in which several corona wires (16.2, 18.2) are arranged next to each other and are held under tension, and the corona wires (16.2, 18.2) are connected with a uniform electrical potential, and the corona wires (16.2, 18.2) designed as individual wires, which have a spring element on one end by which each of the corona wires (16.2, 18.2) is suspended from a first corona wire holder (16.1, 18.1), and an other end of the corona wires (16.2, 18.2) is fastened on an oppositely located corona wire holder (16.1, 18.1).

* * * * *